United States Patent [19]

Thompson et al.

[11] Patent Number: 4,605,017

[45] Date of Patent: Aug. 12, 1986

[54] PERMANENT WAVE CAPE

[76] Inventors: Patricia A. Thompson, Mabry Rd.; Dot M. Wood, Barkersville Rd., both of Angier, N.C. 27501

[21] Appl. No.: 593,544

[22] Filed: Mar. 26, 1984

[51] Int. Cl.[4] ..... A45D 44/00

[52] U.S. Cl. ..... 132/1 R; 132/9; 2/174

[58] Field of Search ..... 132/9, 38, 49; 2/197, 2/171.1, 68; 128/174, DIG. 6

[56] References Cited

U.S. PATENT DOCUMENTS

| | | | |
|---|---|---|---|
| 2,184,240 | 12/1939 | McInnis | 132/9 |
| 2,600,392 | 6/1952 | Cancell | 2/174 |
| 2,600,557 | 6/1952 | Marriott | 132/9 |
| 3,167,785 | 2/1965 | Uhl | 2/174 |
| 3,272,208 | 9/1966 | Hasselbusch, Jr. | 132/9 |
| 3,714,670 | 2/1973 | Finsilver | 2/197 |
| 4,173,042 | 11/1979 | Krzewinski-Morris | 2/197 |

*Primary Examiner*—Gregory E. McNeill
*Attorney, Agent, or Firm*—Mills and Coats

[57] ABSTRACT

This invention is an improved permanent wave cap which provides a means for preventing liquid run-offs from dripping down the face and neck of the person receiving the permanent. Also a means is provided for catching liquids for recycling them back over the head of the customer or person getting the permanent. Additionally a removable storage means is provided to receive curlers and to allow the same to be transported to a washing area for cleaning prior to reuse. Finally the improved permanent wave cape of the present invention is so designed that it can act as a cover or heat bag to prevent heat loss during the setting of the permanent prior to neutralization thereof.

8 Claims, 6 Drawing Figures

PERMANENT WAVE CAPE

FIELD OF INVENTION

This invention relates to beautician equipment and more particularly to the capes used in conjunction therewith.

BACKGROUND OF INVENTION

Since the means of putting permanent waves in hair was first developed, there has been a problem in preventing liquids, whether from the permanent wave solution or the rinses and neutralizers thereof, from running down the face and neck of the person receiving the permanent. Towels were first tied around the head of the person receiving the permanent. In more recent times cape like plastic aprons have been used which snapped around the head of the user. Even with this later development, however, the face of the user is not completely protected and is subject to the annoying and some time dangerous drip of fluids about the face and down the nape of the neck. Absorbent cloth and cotton have been used in attempts to stop the fluid leaks but to little avail.

Also during the giving of a permanent, the solution is poured over the hair of the receiver who has her or his hair rolled on curlers. This solution is preferrably recycled several times but this has been difficult to accomplish since the cape usually drains into a sink or the like.

As the curlers are removed from the hair, they are usually simply placed in the sink and then must be gathered up in a second effort and washed, usually at a different location prior to reuse.

In summary, various steps in the permanent wave process have in the past required the use of towels, cotton, and other means in vain attempts to prevent the face, neck and clothing of the person receiving the permanent from getting wet. Also unnecessary steps have been required during the overall process which adds to the time and effort involved in getting a permanent.

BRIEF DESCRIPTION OF INVENTION

After much research and study into the above-mentioned problems, the present invention has been developed to provide an all purpose permanent wave cape which includes a relatively wide border all the way around the hair line to protect the face, ears and neck of the user thereof from getting wet. This cape is used during the application of the permanent wave solution, is used as a heat bag over the head during the setting of the permanent, is used when rinsing out of the permanent solution, and is used during application and rinsing of the neutralizing lotion.

Because of the special design of the present invention, there is no problem in working with the nape area at the back of the head as has invariably been a problem area in the past.

With the detachable bag provided on the tail of the cape, not only can liquid be caught for recycling but it can also be used for removing used curlers prior to washing thereof.

In view of the above, it is an object of the present invention to provide a multipurpose permanent wave cape for effectively preventing liquids from reaching the face, ears and neck of the user thereof.

Another object of the present invention is to provide a permanent wave cape which includes a trough like bag for catching of run-off of permanent solutions for recycling back over the head of the user thereof.

Another object of the present invention is to provide a permanent cape which includes a combination means for receiving solutions for recycling and acting as a receptor for used curlers.

Another object of the present invention is to provide a receptacle which is attachable to a permanent cape to allow reuse of various solutions involved in the wave process and is detachable for use as a curler container.

Another object of the present invention is to provide a multipurpose permanent wave cape which utilizes non-metallic fasteners and connectors.

Another object of the present invention is to provide a multipurpose permanent wave cape which utilizes velcro as a fastening and attaching means.

Another object of the present invention is to provide a permanent wave cape which doubles as a heat bag during setting of the permanent.

Other objects and advantages of the present invention will become apparent and obvious from a study of the following description and the accompanying drawings which are merely illustrative of such invention.

DETAILED DESCRIPTION OF INVENTION

With further reference to the drawings, the improved permanent wave cape of the present invention, indicated generally at 10, includes a cape portion, indicated generally at 11, and a trough portion, indicated generally at 12.

Referring specifically to the cape portion 11, this is formed from a flexible, water proof material. This can be either a plastic type material of appropriate mil thickness, a plastic coated fabric, or other suitable material.

Figure 1:
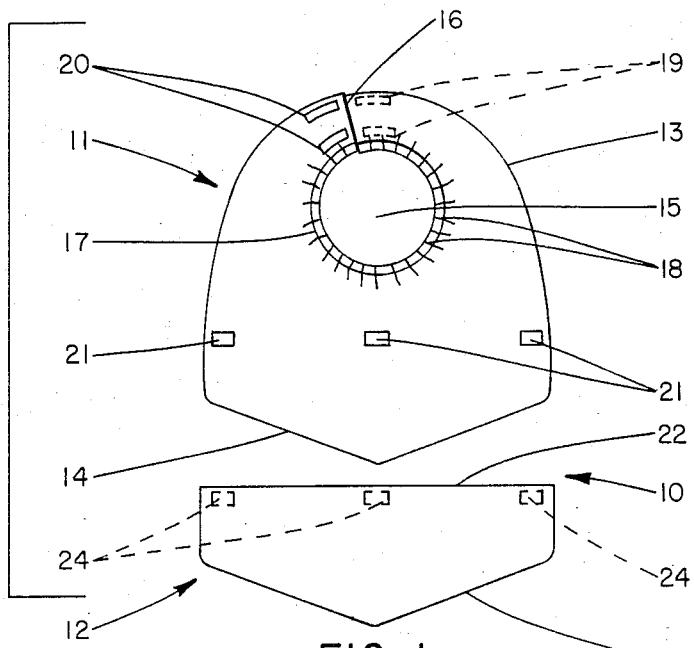
FIG. 1 is an exploded bottom plan view of the permanent wave cape and the detachable trough associated therewith.
Figure 2:
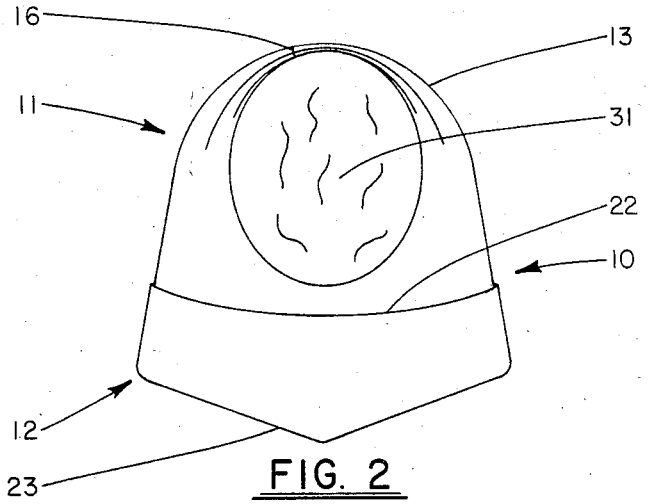
FIG. 2 is a plan view showing the improved permanent wave cape in assembled position.
Figure 3:
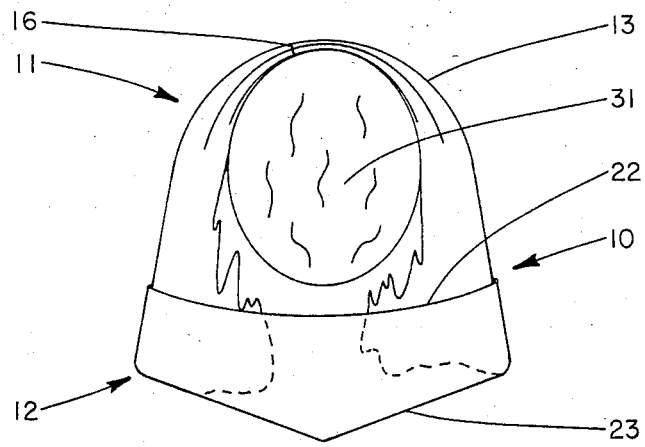
FIG. 3 is a rear elevational view of the present invention in use.
Figure 4:
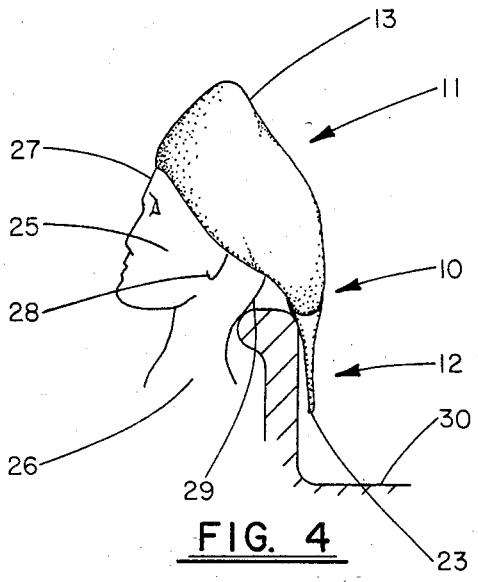
FIG. 4 is a side elevational view of the present invention in use.

The outer edge 13 of the cape portion 11 is generally elliptical shape with the tail portion 14 preferrably coming to a shallow V as shown clearly in FIG. 1.

A generally circular opening 15 is provided with curved edge 13 being cut through to opening 15 as indicated at 16.

The edge of circular opening 15 has an elastic material 17 sewn or otherwise formed therein and, when in the unstretched position, such elastic forms a plurality of gathers 18. When the cape portion 11 is placed about the head 25 of the user 26 thereof, the elastic 17 will stretch and the gathers will generally smooth out and yet the cape can be used for many different sizes of heads with the elastic maintaining a tight seal.

On one side of the cape 11 adjacent cut 16 is a material 19 composed of a multiplicity of small resilient hook means. On the opposite side of cape 11 and on the opposite edge cut 16 but adjacent thereto is a fibrous loop material 20. When the fibrous loop material and the resilient hook material are placed juxtaposed to each other and pressed together, the hooks 19 become entangled in the fibrous loops 20 to form a secure and yet releaseable bond. This bond is relatively easily broken by peeling the layers apart, however, sliding movement between the surfaces is extremely difficult thereby providing a relatively simple securing means of great strength. Securing products of this type are sold under the brand name "Velcro" which is commercially available.

The trough portion 12 is a pocket like affair open along edge 22 with the remaining borders around the pocket portion 12 being sealed. This pocket is formed from a water proof material of an appropriate mil thickness or the like. It should be noted that the bottom 23 of pocket 12 generally conforms to the shallow V shape of tail 14 of cape 11. The purpose of this V shaped bottom is to more readily accumulate liquid at a central point as will hereinafter be described in greated detail. It is to be understood, of course, that should manufacturing expediency or for other reasons it is determined desirable to have the bottom extend straight across, then the tail 14 of the cape 11 would also be modified accordingly.

On the bottom or face side (as distinguished from the hair side) above the cape tail 14 are a plurality of fibrous loop materials 21 secured thereto.

Spaced along the interior of one side of pocket portion 12, adjacent edge 22, are a plurality of resilient hook material patches 24. The hook material patches 24 and the fibrous loop material 21 are so positioned that when the tail 14 of cape 11 is conformingly inserted into the trough like pocket 12, such materials will be juxtaposed to each other and, upon pressure being applied thereto will entangle to releaseably secure the same together in the same manner as hereinabove described for materials 19 and 20.

To use the permanent wave cape of the present invention, opening 15 is placed around the head 25 of the use 26 below the hairline including the nape of the neck 29, adjacent the ears 28 and over the forehead 27 and is secured by placing the hook material 19 juxtaposed to the loop material 20 and pressing the same together. Since the border around opening 15 is at least three inches wide, an adaquate protection shield is thus formed. The elastic material 17 will hold the cape snugly in position and prevent leakage of liquids down the face and the neck of the user.

During washing and rinsing of the hair 31 of the user 26, the tail 14 of the cape 11 can be placed in a sink 30 so that the waste water can be readily drained off and disposed of. This applies also to the application of permanent waving lotion as well as the neutralizing lotion and of course the final rinse. The nape area 29 of the neck can be worked easily without worry of liquids running down the neck as has been a problem in the past. Also, due to the wide border between opening 15 and edge 13, water is effectively prevented from splashing onto the face of the user.

Figure 5:
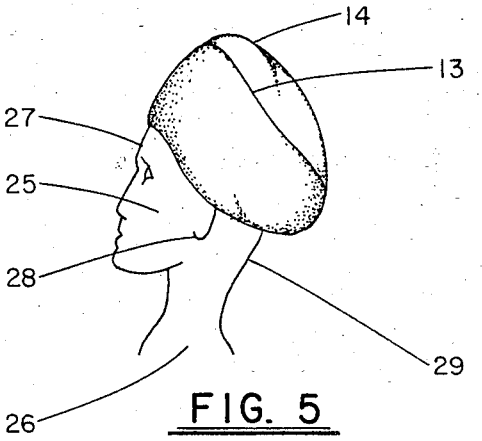
FIG. 5 is a side elevational view of the present invention acting as a heat bag.
Figure 6:
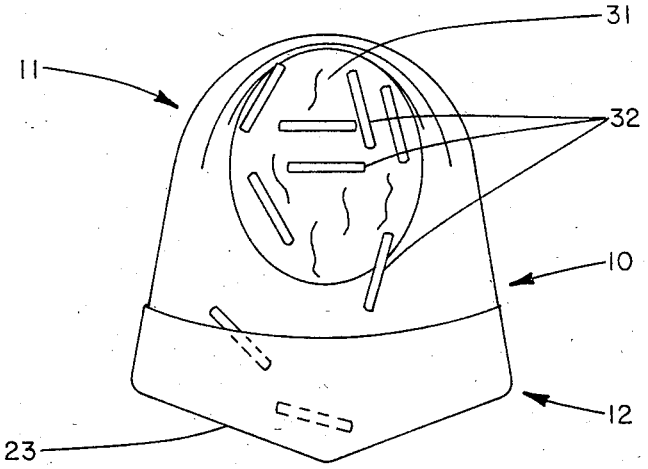
FIG. 6 is a rear elevational view showing the curler storage feature of the present invention.

During the time the permanent lotion is setting, plastic bags have in the past been used to cover the hair 31 to keep the heat in and to aid in the permanent waving process. This has been cumbersome at best and often damages the hair of the user. By taking the tail 14 of the cape and tucking it back over the head of the user as shown in FIG. 5, the permanent wave cape of the present invention can also be used as a heat bag without damaging the user's hair.

During various steps of the permanent waving process, it is desirable at times to recycle the liquids such as rinse water, permanent and neutralizing lotions, and the like. In the past it has been difficult to catch these liquids for re-application.

When using the improved cape of the present invention, the tail 14 thereof is simply inserted into pouch 12 and the Velcro patches 21 and 24 press together to form a releaseable bond between such pouch and such cape. The liquids running off of the cape will collect in the bottom 23 of the pouch and with a cup similar means, the liquid can be dipped out and poured back over the head of the user for recycling as many times as desired.

Whenever it is desired to remove the liquid being worked with, the top edge 22 of pouch 12 can simply be pushed down to drain the pouch or the Velcro fasteners 21 and 24 can be pulled apart and the pouch can be dumped.

In any case the process is continued until the permanent has been set and it is time to remove the curlers 32 from the hair 31 of the user 26. At this point such curlers are removed in the normal manner of such devices and are dropped into pouch 12 which acts as a receiving reservoir. Once all the curlers have been removed from the hair, pouch 12 can be disconnected from cape 11 and taken to a convenient location for washing of the curlers prior to reuse. Also, of course, the pouch can be washed at the same time.

Once the permanent wave process has been completed, the Velcro fasteners 19 and 20 can be pulled apart and the cape removed from the head 25 of the user 26. Such cape can then be washed off and is ready for reuse with the next customer or when ever it is again needed.

From the above it can be seen that the present invention has the advantage of providing a highly effective permanent wave cape which not only prevents undesired liquids from running down the forehead, around the ears, and down the nape of the neck of the user thereof, but also readily lends itself to channeling liquid run-offs into a sink or other receptacle. The present invention has the further advantage of doubling as a heat bag during the permanent setting process. It additionally includes a receptacle for catching liquid run-off for recycling as well as acting as a storage bag for curlers and the like.

The present invention has the even further advantage of allowing the cape to be stored in the pouch between uses thus not only holding the cape in the desired folded condition but also facilitates compact storage thereof. This, of course, can also be an advantage in shipping and in sales displays as well.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claim are intended to be embraced therein.

What is claimed is:

1. A permanent wave cape comprising: a border portion having an opening therein for encircling the head of a user thereof; non metallic means for releasably securing said border portion in encircled position around said head; a combination liquid channeling and heat retaining tail portion outwardly extending from said border portion; and a pouch means releasably attachable to said tail portion by non metallic securing means whereby a combination permanent wave cape is provided which confines liquids being used to the scalp area of the head of the user, allows liquids to be channeled in desired predetermined directions, acts as a heat bag and as a receptacle for liquids being recycled and for used curlers.

2. The permanent wave cape of claim 1 wherein said non-metallic releaseable securing means is of the loop and hook type.

3. The permanent wave cape of claim 1 wherein an elastic border is provided about said opening whereby a tighter, more waterproof seal can be effectuated.

4. The permanent wave cape of claim 1 wherein said pouch includes a shallow V configuration in the bottom thereof.

5. The permanent wave cape of claim 1 wherein said cape is formed from a liquid impervious material.

6. The permanent wave cape of claim 1 wherein said pouch is formed from a liquid impervious material.

7. The permanent wave cape of claim 1 wherein both said cape and said pouch are formed from liquid impervious material.

8. The permanent wave cape of claim 7 wherein liquid impervious materials of are of the sheet plastic type.

* * * * *